US006908664B2

(12) United States Patent
Tsiarkezos

(10) Patent No.: US 6,908,664 B2
(45) Date of Patent: Jun. 21, 2005

(54) PROCESS FOR MAKING STITCHBONDED FABRIC

(75) Inventor: Stephen Horace Tsiarkezos, Elkton, MD (US)

(73) Assignee: Xymid, L.L.C., Chesterfield, VA (US)

( * ) Notice: Subject to any disclaimer, the term of this patent is extended or adjusted under 35 U.S.C. 154(b) by 78 days.

(21) Appl. No.: 10/155,912

(22) Filed: May 22, 2002

(65) Prior Publication Data

US 2003/0220038 A1 Nov. 27, 2003

(51) Int. Cl.[7] ..... B32B 3/06; B32B 27/14; D04B 7/14; D04H 1/74

(52) U.S. Cl. ..... 428/197; 428/102; 428/196; 442/366; 442/414; 66/190; 66/192

(58) Field of Search ..... 442/366, 414; 428/102, 196, 197; 66/190, 192

(56) References Cited

U.S. PATENT DOCUMENTS 3,835,512 A * 9/1974 Piller et al. ..... 28/156
4,619,120 A * 10/1986 Markowitz ..... 66/192
4,704,321 A 11/1987 Zafiroglu ..... 428/230
4,737,394 A 4/1988 Zafiroglu ..... 428/102
4,773,238 A 9/1988 Zafiroglu ..... 66/192
4,876,128 A 10/1989 Zafiroglu ..... 428/102
6,521,554 B1 * 2/2003 Wildeman ..... 442/366
6,821,601 B2 * 11/2004 Tsiarkezos et al. ..... 428/102

* cited by examiner

*Primary Examiner*—Cheryl A. Juska
*Assistant Examiner*—Jenna-Leigh Befumo
(74) *Attorney, Agent, or Firm*—Lawrence Isakoff; Jeffrey C. Lew

(57) ABSTRACT

An improved process for making stitchbonded fabric in which a feed material that has a visible pattern on it is surface is multi-needle stitched with a contractible yarn and then the stitched material is contracted to form an attractive, novel surface pattern that is quite different from the original pattern on the feed material.

11 Claims, 4 Drawing Sheets

PROCESS FOR MAKING STITCHBONDED FABRIC

BACKGROUND OF THE INVENTION

1. Field of the Invention

This invention relates to a process for making a stitchbonded fabric. More particularly, the invention concerns such a process in which a feed material having a readily visible surface pattern is multi-needle stitched and then contracted to provide a stitchbonded fabric having a surface pattern that is different from the surface pattern on the feed material.

2. Description of the Prior Art

Processes and machines for making stitchbonded fabrics are known. Typically, stitchbonded fabrics are made feeding a fibrous material to a multi-needle stitching machine and then stitching the fibrous material with one or more stitching thread systems. Many different kinds of fibrous materials have been employed as feed materials to produce stitchbonded fabrics. Such feed materials include carded webs, thin felts, spunlace fabrics, spunbonded nonwoven sheets, woven or knit fabrics, paper and the like made from various natural and synthetic organic staple fibers or continuous filaments. More recently, U.S. patent application Ser. No. 09/903,805 disclosed coated fabrics, films, foils, leather and combinations of such materials with various fibrous layers as being suitable feed materials for making stitchbonded fabrics.

Known processes for making stitchbonded fabrics typically include the steps of (a) feeding a fibrous material to a stitchbonding machine; (b) threading a multi-needle bar of the stitchbonding machine with stitching threads; (c) inserting the stitching thread into the fibrous material to form spaced apart rows of interconnected stitches, (d) removing the thusly formed stitchbonded fabric from the stitchbonding machine; and (e) optionally subjecting the stitchbonded fabric to further finishing operations, such as dyeing, shrinking, heat setting, molding, coating, impregnating and the like.

Among the stitching threads that have been employed in stitchbonding operations are yarns of natural fibers (e.g., cotton, wool), fibers or filaments of fully drawn, crystalline polymers (e.g., nylon, polyester), fibers of partially molecularly oriented synthetic organic polymer; and threads of spandex, or of other elastic or elastomeric materials. Use of elastic stitching thread, with or without an accompanying non-elastic thread, is disclosed in several patents. Similar use of stitching thread that is shrinkable also has been disclosed. For example, Zafiroglu, U.S. Pat. Nos. 4,876,128, 4,773,238, 4,737,394 and 4,704,321 disclose processes for making bulky and/or stretchy stitchbonded fabrics with various contractible and conventional threads. According to the processes disclosed in these patents, the stitchbonded fabric, upon removal from the multi-needle stitching operation, is allowed or caused to shrink and gather and undergo a significant reduction in fabric area.

To date, the character and appearance of known stitchbonded fabrics has depended mainly on the particular types of stitching yarns, the patterns of stitches formed by the stitching yarns, the amount of shrinkage or contraction and other finishing steps used in the manufacture of the fabrics. These known stitchbonded fabrics have been used successfully in a wide variety of products. However, most stitchbonded fabrics typically have a monotone appearance. The value of stitchbonded fabrics could be enhanced significantly, if while retaining tactile aesthetics and other desirable characteristics, different surface patterns and styling effects could be formed in the fabric during the stitchbonding and contracting process steps.

SUMMARY OF THE INVENTION

The present invention provides an improved process for making a stitchbonded fabric. The process is of the type that includes the steps of (a) feeding a material to a stitchbonding machine; (b) threading a multi-needle bar of the stitchbonding machine with stitching threads; (c) inserting the stitching thread into the material to form spaced apart rows of interconnected stitches, (d) removing the stitched material from the stitchbonding machine; and (e) contracting the stitched material. According to the improved process of the invention, the material fed to the stitchbonding machine is provided with a readily visible pattern on its surface (referred to herein as a "first: or "original" pattern), which after the stitchbonding and contraction steps, provides the surface of the resultant stitchbonded fabric with a second surface pattern which is quite different from the original pattern. The second pattern is not merely a smaller version of the original pattern, decreased in dimensions proportionately to the contracted dimensions of the feed material; it is a different pattern. Typically, the stitched material is contracted in length and/or width to a linear dimension that is 90% or less than the original length and/or width of the stitched material. Contractions to a length and/or width in the range of 50 to 75% of the original dimension are preferred. Also, the contraction is preferably effected during dyeing in a heated dye bath.

The invention also provides a novel stitchbonded fabric. As with known stitchbonded fabrics, the fabric of the present invention comprises a material into which spaced-apart rows of interconnected stitches were inserted with contractible stitching thread and the thusly stitched material was contracted. The stitchbonded fabric of the invention is characterized by a first pattern on the surface of the feed material and a second pattern on the surface of the stitchbonded-and-contracted fabric, the second pattern being different from the first pattern. Details of the first pattern on the surface of the feed material can be determined by simple visual examination of the final stitchbonded fabric, as described hereinafter in the section headed "Test Procedures".

DETAILED DESCRIPTION OF PREFERRED EMBODIMENTS

Figure 1:
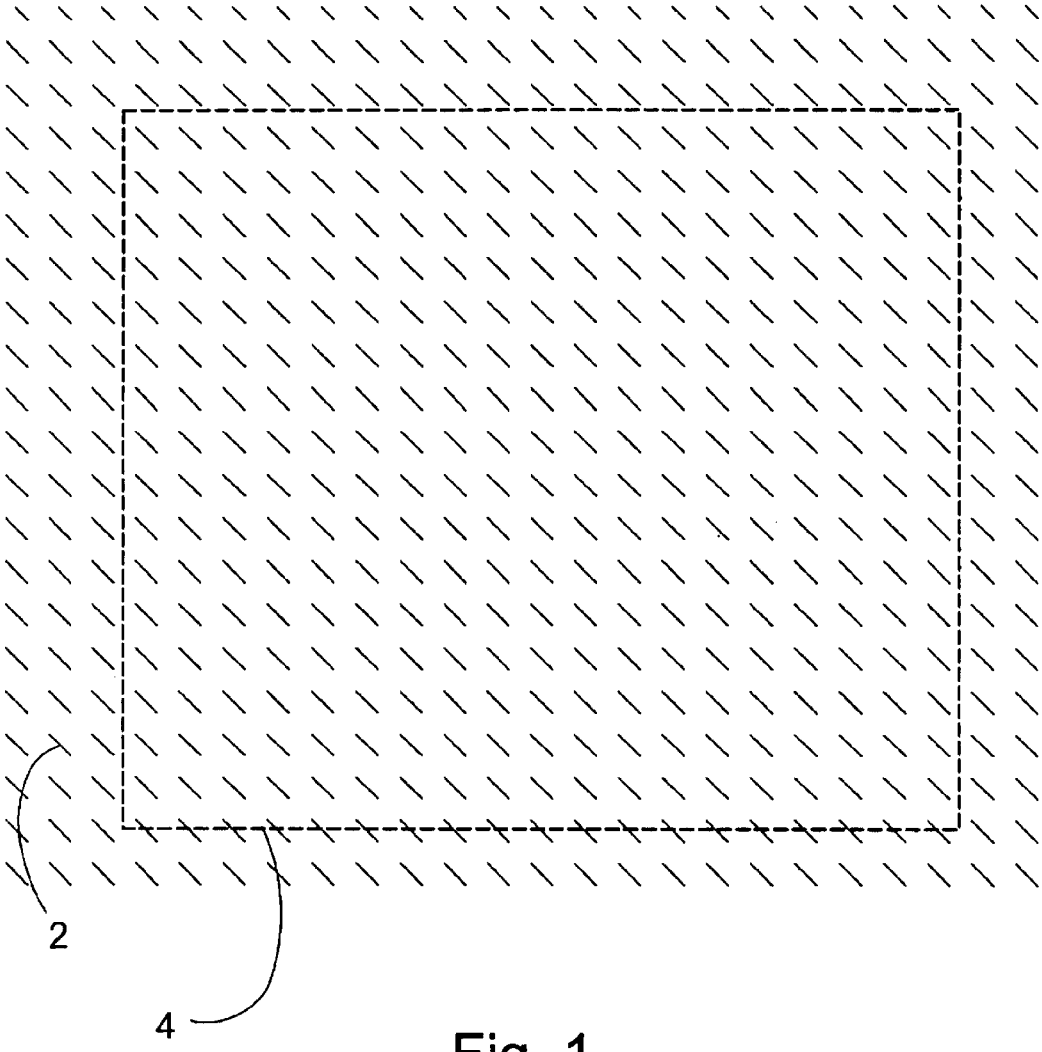
FIG. 1 is a schematic diagram of a plan view of the feed material used in Example 1 prior to passing the feed material through the nip of calendar rolls.

The following detailed description of preferred embodiments of the invention is included for purposes of illustration and is not intended to limit the scope of the invention. The scope is defined by the claims appended below.

As used herein, the term "feed material" refers to a fibrous and/or non-fibrous layer or layers through which thread is multi-needle stitched in fabricating stitchbonded fabric. The term "fiber" includes within its meaning filaments and staple fibers. "Spandex" is a generic term for a manufactured elastic fiber in which the fiber-forming substance is a long chain elastomer comprised of at least 85% segmented polyurethane. The term "original" dimension refers to length and/or width of the stitched fabric as it is formed on the stitchbonding machine, before the contraction step The improved process of the invention and the novel stitchbonded fabric made thereby are in many ways quite similar to conventional stitchbonding processes and stitchbonded fabrics. As in conventional stitchbonding processes, a thin, supple feed material is supplied to a multi-needle stitchbonding machine which inserts spaced-apart rows of interconnected stitches into the feed material with at least one set of contractible stitching threads and the fabric is contracted after stitching.

In contrast to known stitchbonding processes and stitchbonded fabrics, according to the improvement of present invention, the material fed to the stitching operation has a readily discernable visible pattern on its surface. This "first" or "original" pattern on the surface of the feed material can be formed in any of many conventional ways. For example, the feed material surface pattern can be formed by printing, painting, or dyeing with one or more colors, by using yarns of different size, texture, color or composition in forming the feed material, by calendering or bonding to impress different density patterns on the material, by depositing various pigments or other materials in patterns on the surface of the feed material or by employing any other conventional surface pattern-forming process.

Among the various feed materials upon which the first surface pattern can be formed are batts of carded fibers, air-laid fiber batts, wood-pulp papers, lightly bonded spunbonded sheets, spunlace fabrics of hydraulically entangled fibers, non-bonded nonwoven sheets, light-weight woven or knitted fabrics, polymeric films, metal foils, thin layers of leather and the like. Usually, nonbonded fibrous layers are preferred, but lightly bonded or bonded fibrous materials can be employed as long as the bonding does not interfere with any subsequent contraction or other finishing operations to which the stitchbonded fabric may be subjected.

Substantially any elastic or shrinkable thread is suitable for the contractible stitching thread of the stitchbonded fabrics of the invention, provided the contractible thread can exert sufficient force to cause the material into which the contractible thread is stitched to contract and/or pucker after the multi-needle stitching operation. Among such threads are, for example, conventional yarns that can elongate and contract (e.g., bare or covered yarns of rubber or spandex, or textured stretch yarns) or yarns that can be made to shrink after stitching (e.g., (heat shrinkable yarns). A particularly suitable contractible stitching yarn is formed of spandex, which has high elongation and high retractive power. Such yarn is commercially available (e.g., LYCRA® spandex manufactured by E. I. du Pont de Nemours and Co.). Such elastic contractible yarn is placed under tension when inserted into the material being multi-needle stitched, so that when the stitched material is removed from the multi-needle stitchbonding apparatus, the stitching thread contracts and causes the stitched material to contract and pucker. Other types of known contractible yarns can be caused to contract by suitable post-stitching treatments, as noted in the next paragraph.

A wide variety of stitch patterns of the contractible stitching thread, and of other optional stitching threads, can be present in the stitchbonded fabric of the invention. The fabric can be caused to contract by being immersed in a relaxed condition in hot water (e.g., at 85–100° C.) or by being heated in a relaxed condition in air. The contraction can decrease the length and/or width of the fabric to less than 50% of the as-stitched dimensions and the planar area to less than 25% of its as-stitched area, while significantly increasing the thickness of the fabric over its as-stitched thickness. However, linear dimension decreases as small as 10% (i.e. contraction to 90% of an original linear dimension) produce satisfactory results in the stitchbonded fabrics of the invention. Decreases in the length and/or width to 50 to 75% of the original dimension usually are preferred. After contraction, fabrics of the invention that contain elastic yarns are typically elastically stretchable. Also, after contraction, the stitchbonded fabric can be heat treated, while being held at fixed dimensions, to heat set (i.e., stabilize) the dimensions of the fabric.

When the stitchbonded feed material with its first surface pattern is contracted, the fabric generally not only decreases in length and/or width while increasing in thickness, but also changes in structure and surface pattern appearance. The contracted stitched layer of feed material buckles out of plane between the rows of stitches and depending on the amount of shrinkage and on the type of feed material employed provides the surface of the stitchbonded fabric with unusual and desirable characteristics. Parts of the feed material originally on the surface are forced into the thickness of the material and some parts buckle outwards. The contraction thereby creates a new and attractive surface pattern that visually is quite different from the original surface pattern that was applied to the feed material and also is quite different from the monotone surface appearance typically associated with stitchbonded fabrics made by conventional stitchbonding techniques.

The readily visible differences between the original surface pattern on the feed material and the pattern on the surface of the finished, stitched-and-contracted fabric can be further enhanced by dyeing. When the stitching threads differ in dyeability from the substrate into which they are inserted, dyeing results in the visible differences between the original pattern and the second pattern on the final fabric being greatly multiplied. The use of stitching threads of a polymer that is different from polymer of the substrate helps increase the effect of dyeing differences which increase the visibility of the pattern differences.

Conventional multi-needle bar stitching machines (e.g., LIBA or Malimo) and other conventional fabric treating equipment can be used for carrying out the improved process and preparing the novel stitchbonded fabric of the invention.

Test Procedures

In the preceding description of the invention and in the examples below, certain measurements are mentioned. Unless indicated otherwise, these measurements were made by the following procedures.

The weight per unit area of a stitchbonded fabric or of a starting feed material is measured according to ASTM Method D 3776–79. The total thickness of a fabric is measured with a touch micrometer having a ¼-inch (0.64-cm) diameter flat cylindrical probe which applies a 10-gram load to the contacted surface of the fabric.

Decreases in the linear dimensions of a stitchbonded fabric are measured in the longitudinal direction (i.e., parallel to the direction of the rows of stitches) and in the transverse direction (i.e., perpendicular to the longitudinal direction) of the stitchbonded fabric. The as-stitched dimensions (i.e., the initial length, $L_o$, and width, $W_o$, formed on the stitching machine) are measured and compared to the final dimensions (i.e., $L_f$ and $W_f$) of the fabric. The contraction, C, is then expressed as a percentage of the original dimension, as follows:

$$C(\text{length})=100(L_o-L_f)/L_o$$

$$C(\text{width})=100(W_o-W_f)/W_o \text{ and}$$

$$C(\text{area})=C(\text{length})\times C(\text{width})$$

Patterns of color, density, sheen, and the like are readily visible on the surface of the stitchbonded fabric as well as on the surface of the feed material before stitching. After stitching and contraction, the original pattern on the surfacce of the feed material still can be determined by simply removing the stitching thread from the contracted fabric and gently smoothing the material so that it lays substantially flat and non-buckled on a flat surface. Visual examination of the flattened fabric reveals the size, shape, repetition frequency and the like of the original pattern on the surface of the feed material. Comparison of the original pattern with the final pattern observed on the surface of the stitched-and-contracted fabric readily shows the significant differences between the two patterns.

EXAMPLES

In the following examples, stitchbonded fabrics are produced by the process of the invention with various fibrous feed materials and contractible stitching threads. The stitchbonded fabric in each example is formed on a 144-inch (3.66-meter) wide, two-needle bar LIBA stitchbonding machine. Each needle bar is 14-gauge; that is, the machine has 14 needles per inch (5.5/cm). The needle bars also insert 14 stitches per inch (5.5/cm) in the longitudinal direction of the feed material. In each example, the employed needle bars are fully threaded. Conventional warp-knitting nomenclature is used to describe the kinds of repeating stitches that are inserted into the feed material by the stitchbonding machine. After removal from the stitchbonding machine, each stitched fabric is heated in air at 60° C. or in boiling water for about two to three minutes and allowed to contract in length and width. During the stitching operation, the contractible stitching threads are inserted into the non-fibrous layer taut and under sufficient tension to assure that after the heat treatment, the desired contraction and bulkiness are obtained in the final fabric.

Example 1

In this example a feed material having a pattern of uniformly distributed dots on its surface is made into a stitchbonded fabric having a different, attractive non-uniform pattern on its stitched and contracted surface. The feed material, a 0.2-mm-thick nylon staple fiber CEREX® spunbonded sheet, weighing about 20 grams square meter, is passed through the nip of calendar rolls, one of which is a heated engraved roll that forms a repeating isosceles-triangular pattern of spaced-apart circular bonds on the surface of the feed material. Each circular bond is a 0.06-cm diameter spot that is located in a row of dots, extending across the width of the feed material (i.e., in the cross machine or transverse direction of the material). Within the row, each dot was separated from its closest neighboring dots by 0.18-cm and each transverse row is separated from its closest neighboring rows by 0.11 cm.

The dotted feed material is multi-needle stitched on the two-bar stitching machine The machine is fully threaded with an elastic yarn of 70-denier (78-dtex) LYCRA® spandex (manufactured by E. I. du Pont de Nemours & Co.) wrapped with a 40-denier (44-dtex), 34-filament nylon yarn, on the back bar which inserts 0-1,1-0 chain stitches, and with a 70-denier (78-dtex) 34-filament textured polyester yarn on the front bar, which inserts 1-2,1-0 stitches.

The thusly stitched feed material is then passed, in an unrestrained state, through a 97° C. aqueous dye bath which dyes the stitched material black and causes it to contract to 50% of its as-stitched length and to 95% of its as-stitched width and to increase to about 130% of its as-stitched thickness. As a result of the contraction and thickening, the pattern of dots on the surface of the material pattern is greatly rearranged. The stitched, contracted and dyed material exhibits numerous elliptical areas non-uniformly distributed over its surface. Within each elliptical area, each having a major axis of about 2 cm and a minor axis of about 1.5 cm, are clusters of many non-uniformly distributed dots. The new pattern provides an interesting effect of numerous tones of color gradations across the entire fabric. Such surface color effects and interest are remarkably different from the surface appearance of known stitchbonded fabrics.

Example 2

Figure 2:
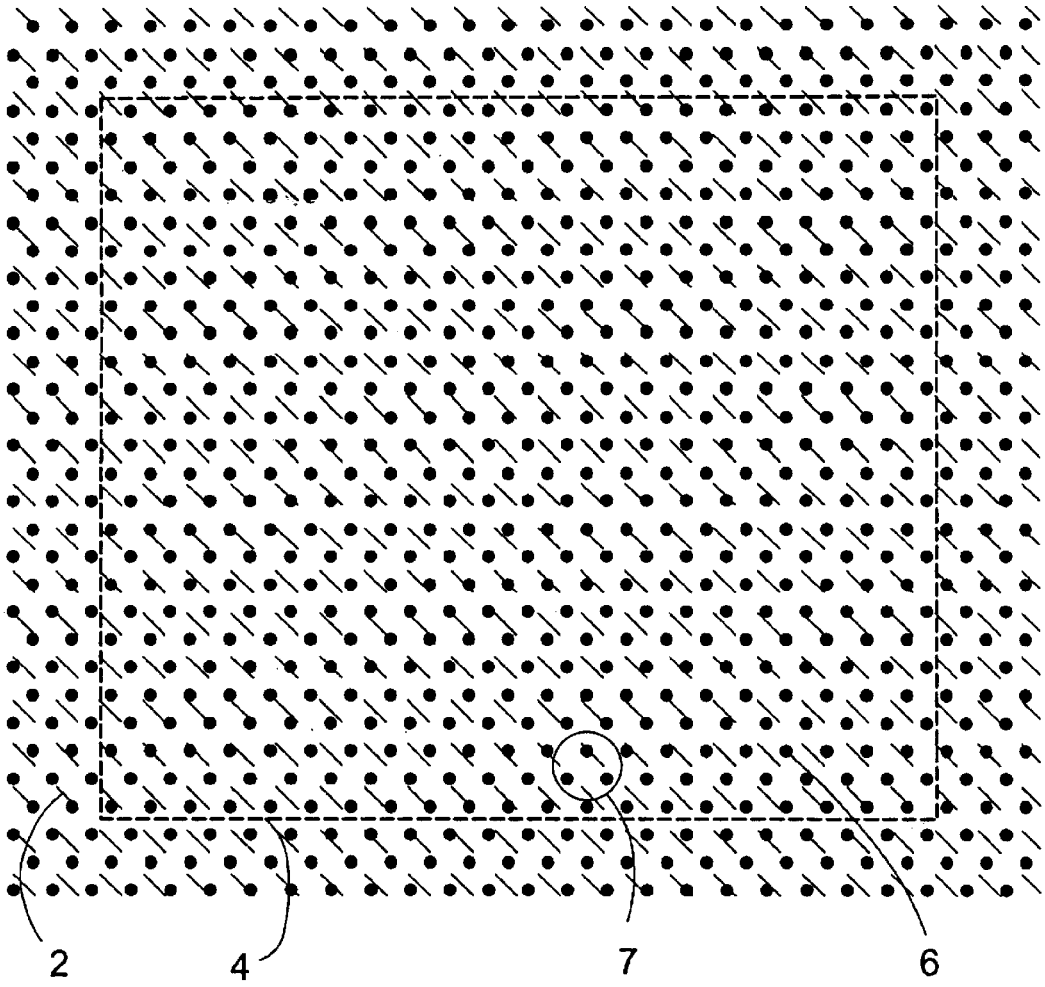
FIG. 2 is a schematic diagram of a plan view of the feed material of FIG. 1 after passing the feed material through the nip of calendar rolls that formed a repeating isosceles triangular pattern of dots on the surface of the feed material.
Figure 3:
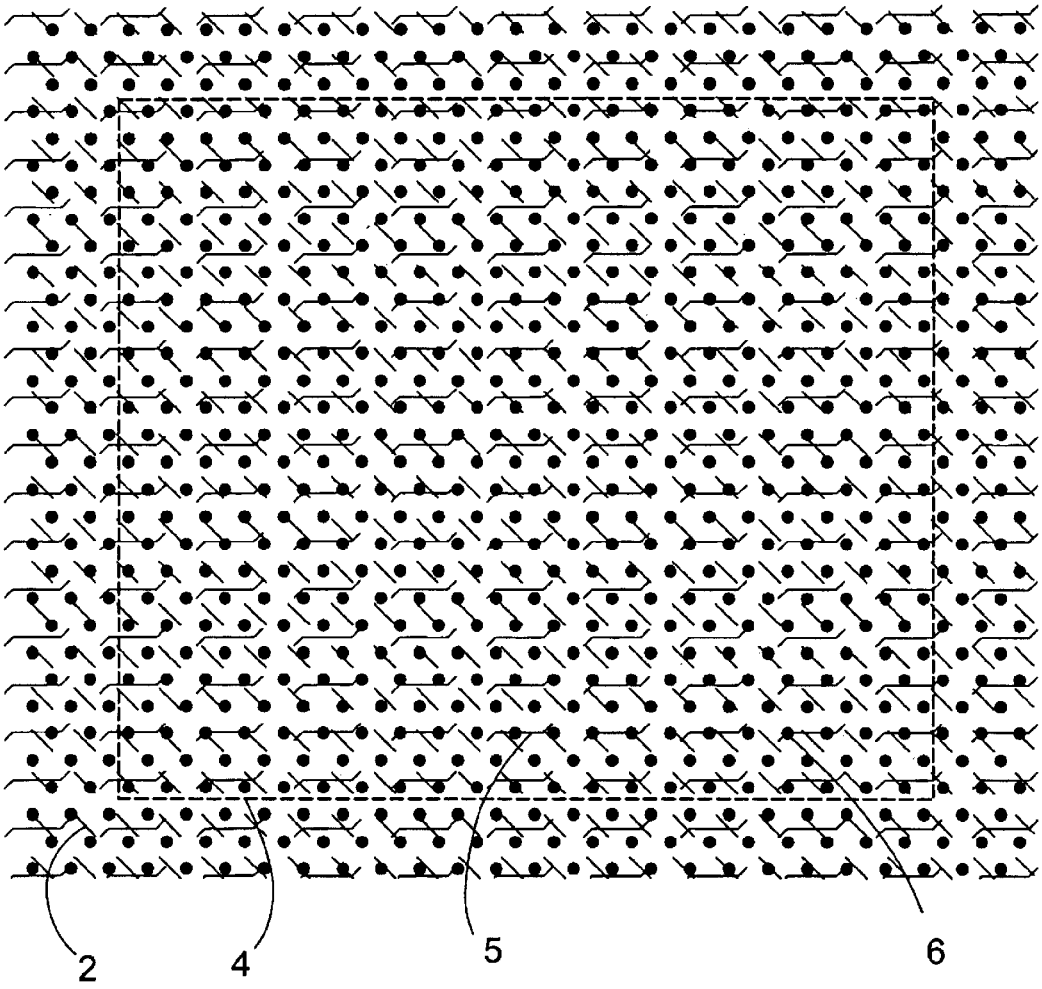
FIG. 3 is a schematic diagram of a plan view of the feed material of FIG. 2 after stitchbonding according to Example 1.
Figure 4:
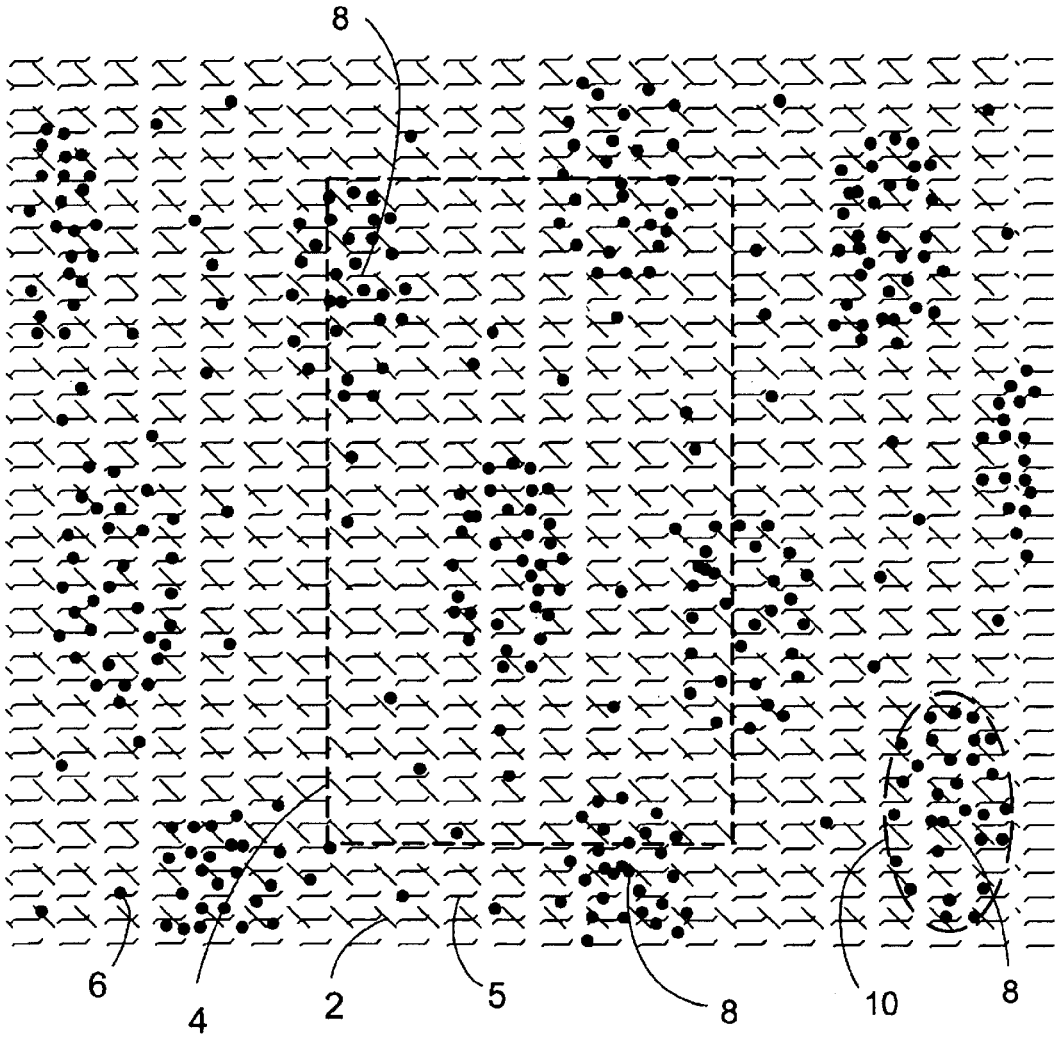
FIG. 4 is a schematic diagram of a plan view of the feed material of FIG. 3 after heat treating according to Example 1.

The change in pattern demonstrated in this example can be graphically summarized by FIGS. 1–4. FIG. 1 shows a schematic representation of a plan view of a portion of the nylon staple fiber, spunbonded sheet feed material 2 prior to passing the sheet through the calendar rolls. A dashed line 4 is superimposed on the sheet to indicate a square reference area bounded by a single unit dimension of width and length. FIG. 2 shows a schematic representation of a plan view of the same portion of feed material of FIG. 1 after the feed material was passed through the nip of embossing calendar rolls. Circular dots 6 are seen to be disposed in an isosceles triangular pattern as described above. A single isosceles triangle pattern of dots is highlighted within circle 7. Like elements have the same reference numbers in the figures. FIG. 3 shows a schematic representation of a plan view of the feed material containing the portion of FIG. 2 after stitchbonding with the elastic, contractible spandex nylon yarns 5. The textured composite material after heat-treating the precursor feed material of FIG. 3 in the dye bath as described above is schematically represented in FIG. 4. For clarity, the effect of the dye to change the feed material color to black is not shown in the figure. The feed material is seen by the reduced dimensions of the dashed line 4 to have contracted to 50% of its as-stitched length and to 95% of its as-stitched width. Line 4 in FIG. 3 is drawn to scale relative to FIGS. 1–3. As a result of the lateral shrinking and increased depth of the fabric due to contraction of the yarns, FIG. 4 shows that dots 6 on the visible surface of the contracted fabric appear to have been rearranged to a second pattern different from the original, repeating isosceles triangular pattern. Specifically, the dots appear to arranged in clusters 8. The clusters are approximately elliptical. For illustrative purposes only a dashed outline 10 is superimposed on the figure to highlight the elliptical shape of a representative clustered dots. The dots are non-uniformly distributed within the clusters. The clusters are non-uniformly distributed over the surface of the contracted fabric.

In this example, the surface of a feed material of 0.1-mm thick, 40-g/m$^2$ TYVEK® spunbonded olefin sheet (not bonded) is printed with black dots and then is formed into a stitchbonded fabric having a different attractive pattern on its stitched-and-contracted surface. The pattern of black dots is stamped on the surface of the feed material by pressing an ink-loaded engraved plate against the surface of the feed material. A repeating isosceles-triangular pattern of spaced-apart circular black dots, is printed similar to that of example 1, but with the dots more widely spaced apart. Each black dot is about 0.085-cm diameter is in a row of dots that extends across the width of the feed material. Within each row, each dot is separated from its closest neighboring dots by 5.28 cm. Each transverse row is separated from its closest neighboring rows by 5.28 cm.

The nonwoven feed material with its printed pattern of black dots is multi-needle stitched on the fully threaded, two-bar stitching machine, with the same stitching yarns as in Example 1. A series of 1-0,1-0,1-2,1-2 stitches is made by the elastic yarn threaded on the front bar and a series of 1-0,1-2 stitches is made with the textured nylon yarn threaded on the back bar.

The thusly stitched feed material is then passed, in an unrestrained state, through a 90° C. aqueous bath which causes the stitched material to contract to 50% of its as-stitched length and to 80% of its as-stitched width and to increase to about 135% of its as-stitched thickness. As a result of the contraction and thickening, the pattern of colored dots on the surface of the material is significantly rearranged from what it was on the feed material. The stitched-and-contracted material exhibits numerous dark and light areas of varying lengths and widths, non-uniformly distributed over the surface of the finished fabric. The new pattern is considered to provide a very attractive fabric for apparel and furniture covers.

Example 3

This example employs a feed material that is a nonwoven stitchbonded sheet that is over-stitched (i.e., further stitchbonded) on the two-bar stitchbonding machine. The surface pattern formed by the stitching in the non-woven stitchbonded feed material is transformed into an entirely different pattern by subsequent contraction of the over-stitched (i.e., further stitchbonded) fabric.

A nonwoven feed material is prepared by one 14-gauge, multi-needle bar stitching 1-0,0-1 chain stitches with a 33-filament, 270-denier (300dtex) partially molecularly oriented polyester yarn (commonly called a "POY") into a 20-g/m$^2$ polyester-powder-bonded, nylon-staple-fiber card (manufactured by HDK Industries of Tennessee). This feed material has a clear pattern of vertical lines, separated from each other by 0.18 cm and extending along the length of the feed material. The thusly prepared feed material is over-stitched with one bar of the multi-needle stitching machine threaded with a two ply, 70-denier (78-dtex), 34-filament textured yarn that forms 1-0,3-4 stitches. Stitch spacing along the length of the stitched fabric is 0.18 cm (i.e., 5.5 stitches per cm) and spacing across the width of the fabric is 0.18 cm (i.e., 5.5 vertical lines of stitches per cm).

The stitched and overstitched fabric of the preceding paragraph was subjected to dyeing and finishing. The fabric was dyed an orange color in a 90° C. aqueous dye bath and contracted in the length direction to 65% of its as-stitched length and to about 93% of its as-stitched width. The surface appearance of the dyed fabric showed substantially none of the original pattern of vertical lines of feed material. Instead, the surface pattern of the contracted, dyed and finished stitchbonded fabric exhibited an attractive, unusual pattern of light and dark zig-zag bands of varying width, non-uniformly distributed over the entire final fabric.

I claim:

1. An improved stitchbonded fabric which comprises a layer of fibrous feed material having a surface exhibiting a first pattern while the feed material is in an uncontracted state, rows of multi-needle stitching of a contractible stitching thread inserted through the feed material while the feed material and stitching thread are in an uncontracted state, and a second pattern on the fabric, the second pattern being formed by contraction of the thread from the uncontracted state such that the second pattern is visually irregular and different from the first pattern.

2. An improved stitchbonded fabric in accordance with claim 1 wherein the first pattern on the surface of the feed material is formed by bonded and non-bonded areas.

3. An improved stitchbonded fabric in accordance with claim 1 wherein the first pattern on the surface of the feed material is formed by colored and non-colored areas.

4. An improved stitchbonded fabric in accordance with claim 1 wherein the first pattern on the surface of the feed material is formed by areas on which pigmented or other material has been deposited.

5. The stitchbonded fabric of claim 1 in which the second pattern is such that the first pattern visually appears rearranged.

6. The stitchbonded fabric of claim 5 which the second pattern appears to comprise a rearrangement of the first pattern that is different from a decrease in dimensions proportional to the dimensional contraction of the feed material.

7. The stitchbonded fabric of claim 1 in which the first pattern has a uniform distribution over the surface of the feed material and the second pattern has a non-uniform distribution over the surface of the stitchbonded fabric.

8. The stitchbonded fabric of claim 7 in which the first pattern is defined by visually distinctive areas positioned on the surface of the feed material and the second pattern defines clusters of the visually distinctive areas non-uniformly distributed within the clusters.

9. The stitchbonded fabric of claim 1 in which the feed material is free of stitchbonds such that the first pattern is visually apparent on the surface of the non-stitchbonded feed material.

10. The stitchbonded fabric of claim 1 in which the feed material has an original width dimension and an original length dimension at least one of which is contracted to about 50–75% in the stitchbonded fabric.

11. A stitchbonded fabric formed by the process comprising the steps of:

(A) providing a layer of fibrous feed material having a surface, (B) creating a regular first pattern visually apparent on the surface, (C) multi-needle stitchbonding the feed material with rows of a contractible stitching thread, (D) contracting the contractible stitching thread such that the stitchbonded fabric contracts effectively to form thereon an irregular second pattern different from the first pattern.

* * * * *